US009081331B2

(12) United States Patent
Yamagishi

(10) Patent No.: US 9,081,331 B2
(45) Date of Patent: Jul. 14, 2015

(54) DEVELOPING DEVICE AND IMAGE FORMING APPARATUS

(71) Applicant: KYOCERA Document Solutions Inc., Osaka (JP)

(72) Inventor: Yoshihiro Yamagishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/454,362

(22) Filed: Aug. 7, 2014

(65) Prior Publication Data

US 2015/0050041 A1 Feb. 19, 2015

(30) Foreign Application Priority Data

Aug. 13, 2013 (JP) ..... 2013-168331

(51) Int. Cl.
*G03G 15/08* (2006.01)
*G03G 15/09* (2006.01)

(52) U.S. Cl.
CPC ..... *G03G 15/0942* (2013.01); *G03G 15/0817* (2013.01); *G03G 15/0812* (2013.01)

(58) Field of Classification Search
CPC ..... G03G 15/0817; G03G 15/0898; G03G 15/0942; G03G 2215/0614; G03G 15/0813; G03G 15/0877; G03G 15/0881; G03G 15/0882; G03G 15/0893; G03G 15/0894; G03G 15/09; G03G 15/0928
See application file for complete search history.

(56) References Cited

U.S. PATENT DOCUMENTS

| | | | | |
|---|---|---|---|---|
| 5,790,923 | A | 8/1998 | Oguma et al. | |
| 2004/0001727 | A1 * | 1/2004 | Akutsu | 399/104 |

FOREIGN PATENT DOCUMENTS

| | | | | |
|---|---|---|---|---|
| CN | 1162773 | | 10/1997 | |
| CN | 1082200 | | 4/2002 | |
| DE | 69721098 | | 12/2003 | |
| EP | 0789286 | A2 | 8/1997 | |
| EP | 0789286 | A3 | 11/1998 | |
| EP | 0789286 | B1 | 4/2003 | |
| JP | H09-218578 | | 8/1997 | |
| JP | 2001-350344 | * | 12/2001 | G03G 15/08 |
| JP | 2003-005518 | | 1/2003 | |
| JP | 3372747 | | 2/2003 | |
| KR | 100210885 | | 7/1999 | |

* cited by examiner

*Primary Examiner* — Roy Y Yi
(74) *Attorney, Agent, or Firm* — Knobbe, Martens, Olson & Bear LLP

(57) ABSTRACT

A developing device includes a developing roller, a regulating blade, seal members, and contact members. The regulating blade extends in a rotation axis direction of the developing sleeve, is disposed opposite to a circumferential surface of the developing sleeve, and regulates a quantity of the toner on the circumferential surface of the developing sleeve. The seal members are disposed opposite to the circumferential surface without being in contact with both ends of the developing region in the rotation axis direction. Each contact member is an edge on the developing region side in the rotation axis direction, provided at a position at an upstream side in a rotational direction of the circumferential surface of the developing sleeve relative to an arrangement position of the regulating blade, and configured to be in contact with the circumferential surface of the developing sleeve.

7 Claims, 14 Drawing Sheets

DEVELOPING DEVICE AND IMAGE FORMING APPARATUS

INCORPORATION BY REFERENCE

This application claims priority to Japanese Patent Application No. 2013-168331 filed on 13 Aug. 2013, the entire contents of which are incorporated by reference herein.

BACKGROUND

This disclosure relates to a developing device that forms a toner image by feeding toner toward an electrostatic latent image formed on a circumferential surface of a photosensitive drum by electrophotography and an image forming apparatus having the same, and particularly to a technique for preventing leakage of toner on a circumferential surface of a developing sleeve.

In such an electrophotographic image forming apparatus, a toner image is formed by feeding toner from a developing device toward an electrostatic latent image formed on a surface of a photosensitive drum. Such a developing device has a developing roller made up of a magnet roller and a developing sleeve, forms a toner layer on a circumferential surface of the developing sleeve, and feeds toner from the developing sleeve to the surface of the photosensitive drum.

In such a developing device, a seal member made of a magnet is used as a member for preventing the toner on the circumferential surface of the developing sleeve from leaking out of a developing region. The seal member prevents the toner from leaking out of the developing region by causing a concentrated magnetic field to be formed at magnetic poles of the magnet roller and edges (corners) of the seal member by a magnetic field emitted from the magnet roller that is disposed at a fixed distance from the developing sleeve and is encased in the developing sleeve, and by forming a magnetic brush depending on the toner. During the rotation of the circumferential surface of the developing sleeve, a part of the toner which is present within a sealing region caused by the seal member may remain attached to a surface of the developing sleeve, and a toner layer may be formed on the developing sleeve. However, such a toner layer is recovered from the circumferential surface of the developing sleeve along with the rotation of the developing sleeve by a tip of the seal member (which is a seal member portion located furthest upstream in a rotational direction of the circumferential surface of the developing sleeve, and is called a jaw part). However, the collected toner gradually accumulates at the tip by repetition of the developing operation, and eventually falls outside a developing unit, causing leakage of the toner.

For this reason, there is a proposal for a developing device A for preventing the toner from accumulating on the tip of the seal member by providing a developer scraping member in the vicinity of a gap portion between the developing sleeve and the magnetic seal and coming into contact with the developing sleeve to thereby scrape up a developer.

Further, there is also a proposal for a developing device B for preventing the developer from accumulating on the tip of the seal member by forming a taper at the tip of the seal member.

SUMMARY

As an aspect of this disclosure, a technique further improving the aforementioned technique is proposed.

A developing device according to an aspect of this disclosure includes a developing roller, a regulating blade, seal members, and contact members.

The developing roller includes a magnet roller having numerous magnetic poles in a circumferential direction thereof and a roller-shaped developing sleeve sheathed on the magnet roller, and feeds toner to a photosensitive drum.

The regulating blade extends in a rotation axis direction of the developing sleeve, is disposed opposite to a circumferential surface of the developing sleeve, and regulates a quantity of the toner present on the circumferential surface of the developing sleeve.

The seal members are disposed opposite to the circumferential surface without being in contact with both ends of the developing region in the rotation axis direction on the circumferential surface of the developing sleeve, and inhibit the toner on the developing region from moving to the rotation axis direction ends by magnetic brushes formed between the magnet roller and the seal members.

Each of the contact members is an edge on the developing region side in the rotation axis direction on an inner circumferential surface of each seal member which is opposite to the circumferential surface of the developing sleeve, is provided at a position at an upstream side in a rotational direction of the circumferential surface of the developing sleeve relative to an arrangement position of the regulating blade, and is in contact with the circumferential surface of the developing sleeve.

An image forming apparatus according to an aspect of this disclosure includes an image carrier, a charging part, an exposing part, and the developing device.

The image carrier forms a toner image on a surface thereof.

The charging part charges the surface of the image carrier.

The exposing part exposes the surface of the image carrier which is charged by the charging part, and forms an electrostatic latent image.

DETAILED DESCRIPTION

Figure 1:
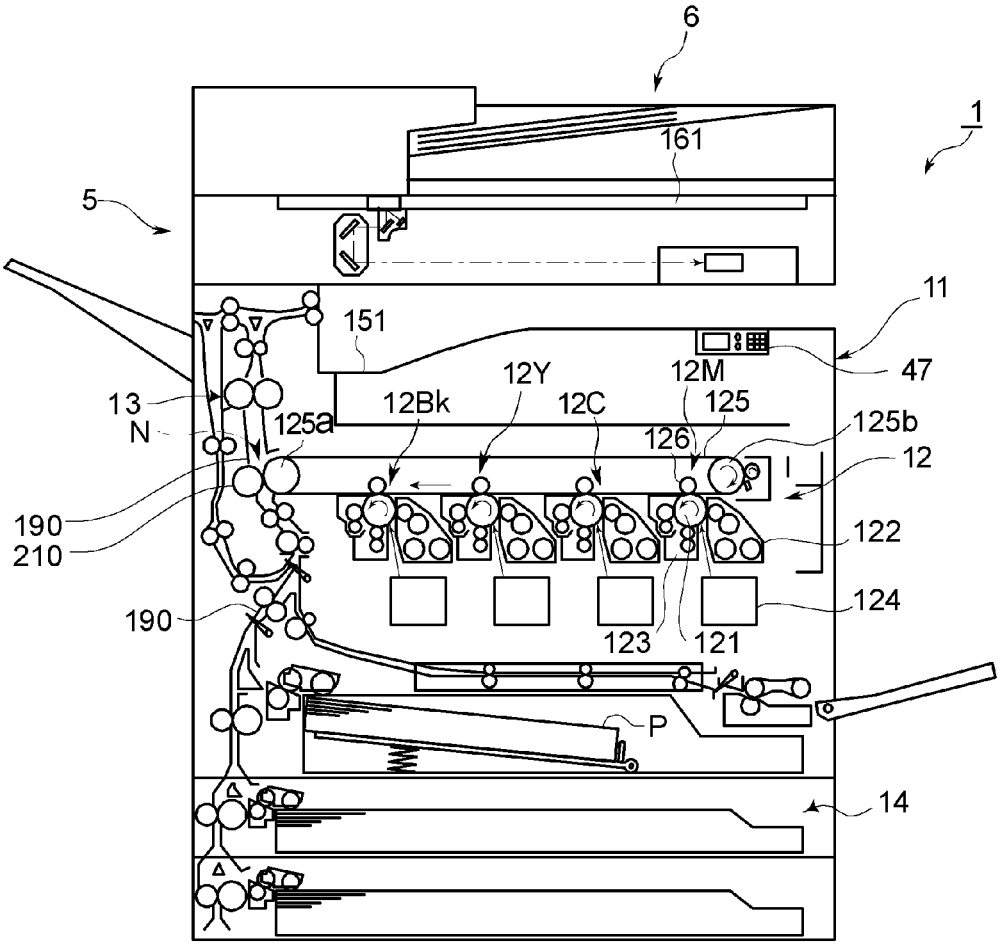
FIG. 1 is a front cross-sectional view illustrating a structure of an image forming apparatus having a developing device according to an embodiment of this disclosure.

Hereinafter, a developing device and an image forming apparatus having the same according to an embodiment of this disclosure will be described with reference to the drawings. FIG. 1 is a front cross-sectional view illustrating a structure of an image forming apparatus having a developing device according to an embodiment of this disclosure.

An image forming apparatus 1 according to an embodiment of this disclosure is, for instance, a multifunction device combining numerous functions such as a copy function, a printer function, a scanner function, and a facsimile function. The image forming apparatus 1 includes an apparatus main body 11 equipped with an operation unit 47, an image forming unit 12, a fixing unit 13, a paper feed unit 14, a document feed unit 6, and a document scanning unit 5.

When the image forming apparatus 1 performs a document scanning operation, the document scanning unit 5 optically scans an image of a document fed by the document feed unit 6 or an image of a document placed on a document table glass 161 to generate image data. The image data generated by the document scanning unit 5 is stored in an internal hard disk drive (HDD) or a networked computer.

When the image forming apparatus 1 performs an image forming operation, the image forming unit 12 forms toner images on recording paper P as a recording medium fed from the paper feed unit 14 based on the image data generated by the document scanning operation or the image data stored in the internal HDD. Each of image forming units 12M, 12C, 12Y, and 12Bk of the image forming unit 12 is equipped with a photosensitive drum 121, a charging device 123, an exposing device 124, a developing device 122, and a primary transfer roller 126.

The developing device 122 of each of the image forming units 12M, 12C, 12Y, and 12Bk contains toner for developing an electrostatic latent image. The developing device 122 supplies the corresponding toner to a surface of the photosensitive drum 121 after the toner is charged by the charging device 123 and is exposed by the exposing device 124.

When color printing is carried out, the image forming unit 12M for magenta, the image forming unit 12C for cyan, the image forming unit 12Y for yellow, and the image forming unit 12Bk for black of the image forming unit 12 cause the toner images to be formed on photosensitive drums 121 by charging, exposing, and developing processes based on images composed of respective color components constituting the image data, and cause the toner images to be transferred to an intermediate transfer belt 125 stretched on a driving roller 125*a* and a driven roller 125*b* by primary transfer rollers 126.

The intermediate transfer belt 125 has image carrying surfaces to which the toner images are transferred and which are set for an outer circumferential surface thereof, and is driven by the driving roller 125*a* in contact with circumferential surfaces of the photosensitive drums 121. The intermediate transfer belt 125 endlessly travels between the driving roller 125*a* and the driven roller 125*b* while being synchronized with each photosensitive drum 121.

Each chromatic toner image transferred onto the intermediate transfer belt 125 is superposed on the intermediate transfer belt 125 by adjusting transfer timing, and becomes a color toner image. A secondary transfer roller 210 causes the color toner image formed on the surface of the intermediate transfer belt 125 to be transferred to the recording paper P, which is conveyed from the paper feed unit 14 along a conveying path 190, at a nip zone N across the intermediate transfer belt 125 between the secondary transfer roller 210 and the driving roller 125*a*. Afterwards, the fixing unit 13 causes the toner image on the recording paper P to be fixed to the recording paper P by thermocompression. The recording paper P on which the fixing process is completed and on which a color image is formed is ejected to an eject tray 151.

Figure 2:
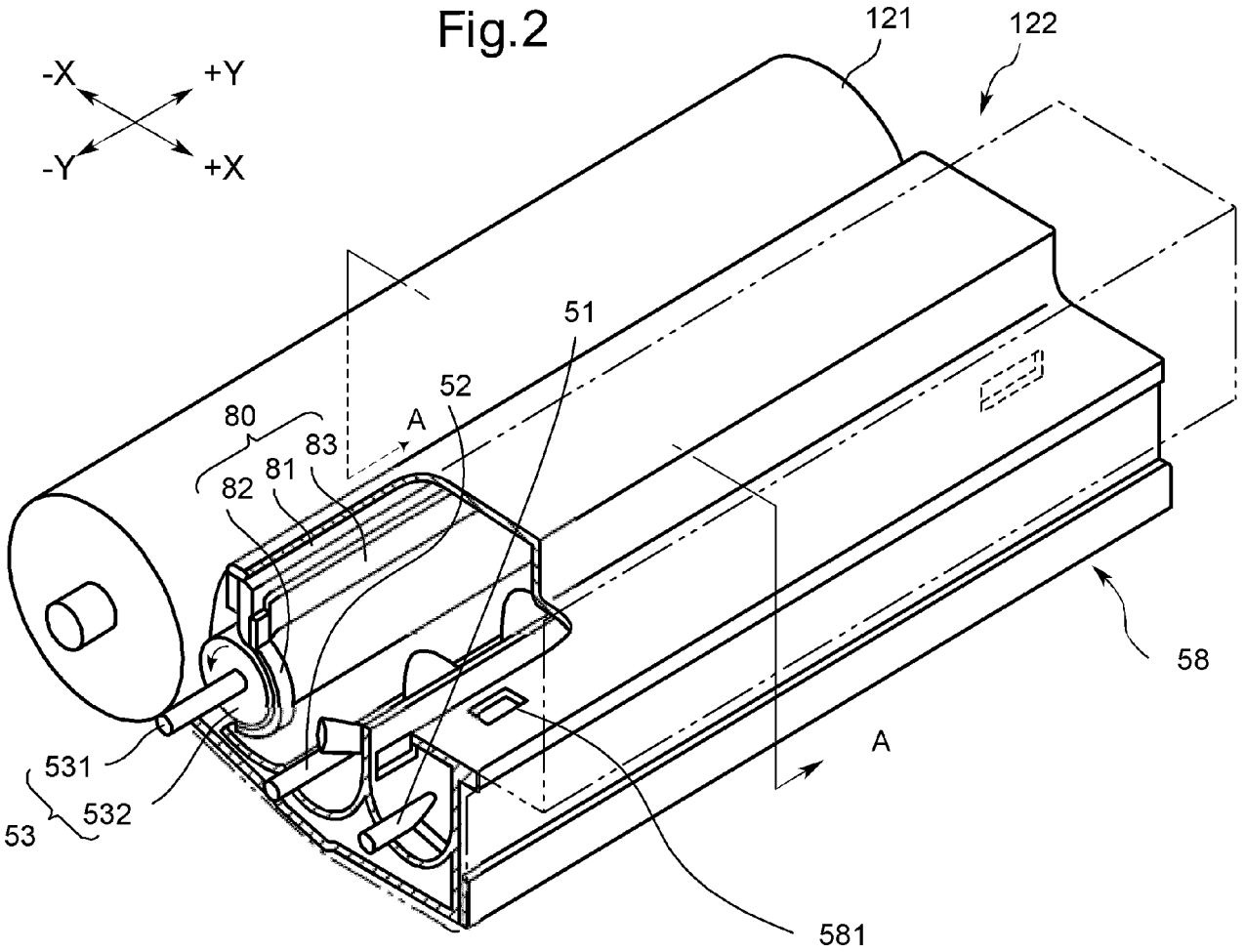
FIG. 2 is a perspective view illustrated by cutting out a part of the developing device.
Figure 3:
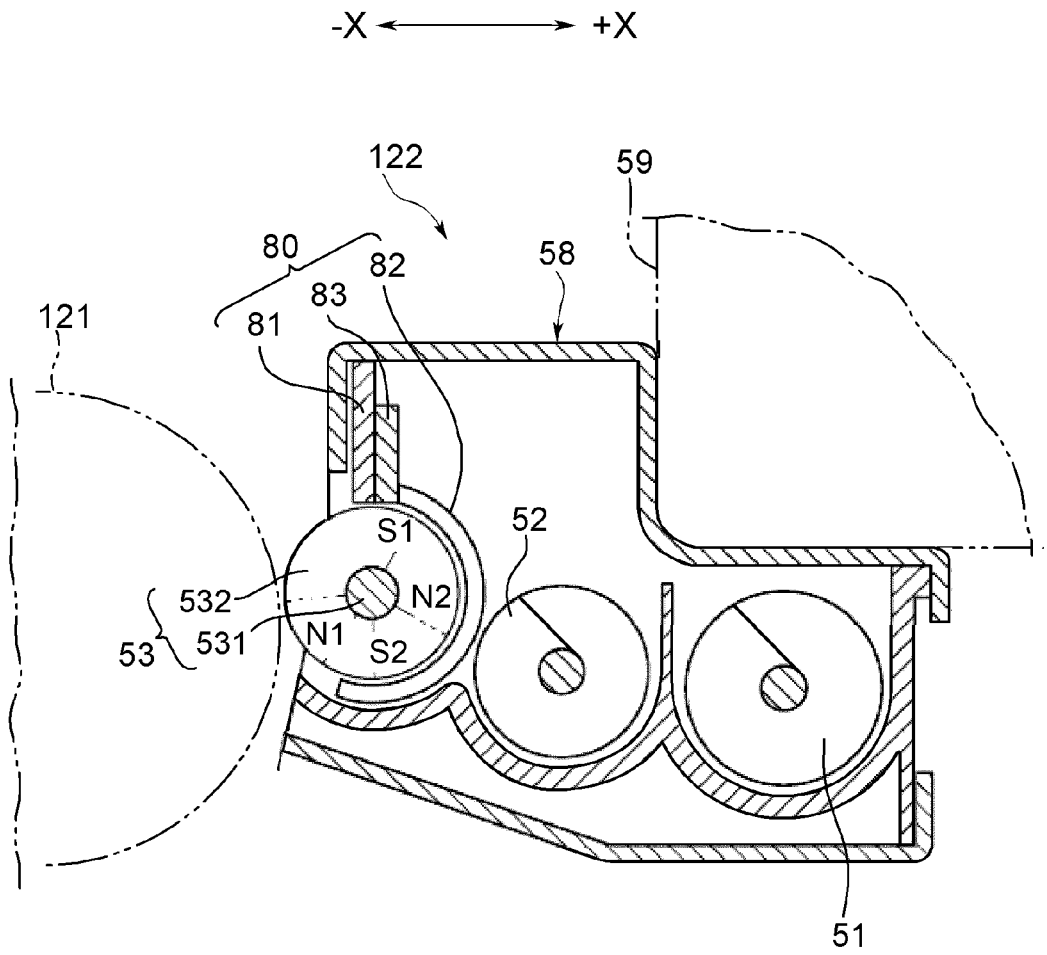
FIG. 3 is a cross-sectional view taken along line A-A in FIG. 2.

Next, a constitution of the developing device 122 will be described. FIG. 2 is a perspective view illustrated by cutting out a part of the developing device 122. FIG. 3 is a cross-sectional view taken along line A-A in FIG. 2. In FIGS. 2 and 3, an X-X direction is referred to as a leftward/rightward direction, and a Y-Y direction is referred to as a frontward/rearward direction. Particularly, a −X direction is referred to as a left side, a +X direction as a right side, a −Y direction as a front side, and a +Y direction as a rear side.

As illustrated in FIGS. 2 and 3, the developing device 122 is equipped with a first spiral feeder 51, a second spiral feeder 52, and a developing roller 53 in a casing 58.

The first spiral feeder 51 conveys toner replenished from a toner container 59 toward the rear side while agitating the toner. The second spiral feeder 52 conveys the toner handed from the first spiral feeder 51 toward the front side. The developing roller 53 receives the toner conveyed by the second spiral feeder 52 and supplies the toner to a latent image region of the circumferential surface of the photosensitive drum 121.

The developing roller 53 includes a magnet roller 531 and a developing sleeve 532. The developing sleeve 532 is sheathed on the magnet roller 531. The developing sleeve 532 is rotatably supported by the casing 58 at a position adjacent to the surface of the photosensitive drum 121 and the second spiral feeder 52. The developing sleeve 532 is formed of a nonmagnetic material such as aluminum in a cylindrical shape, and a surface roughness Rz thereof is finished to, for instance, 10 μm or less.

The magnet roller (magnetic member) 531 is a permanent magnet that is fixedly installed in the developing sleeve 532. The magnet roller 531 has numerous magnetic poles made up of S and N poles that are alternately arranged in a circumferential direction, and generates a magnetic field toward the developing sleeve 532. Further, the developing roller 53 is exposed from an opening of the casing 58, and is opposite to the photosensitive drum 121 that is an image carrier at a fixed distance. Such an opposite region becomes a developing region for supplying the toner carried on the developing sleeve 532 toward the photosensitive drum 121. To supply the toner to the photosensitive drum 121, a developing bias obtained by superposing alternating current on direct current is applied to the developing sleeve 532.

For example, a magnetic pole Si is disposed at a position of the magnet roller 531 which is located opposite to a regulating blade 81. Further, a magnetic pole N1 is disposed at a position facing the developing region. Furthermore, a magnetic pole S2 is disposed on a toner circulation region to which remaining toner after development is conveyed. In addition, a magnetic pole N2 is disposed at a position facing the second spiral feeder 52.

The toner, which is fed from the toner container 59 through a toner feed opening 581 of the casing 58 by a magnetic force of the magnet roller 531 and moves from the first and second spiral feeders 51 and 52, is carried on the circumferential surface of the developing sleeve 532. Further, the toner is fed to the first spiral feeder 51 from a toner container (not shown) through the toner feed opening 581 of the casing 58.

The regulating blade 81 regulates the toner carried on the circumferential surface of the developing sleeve 532 to a predetermined layer thickness, and is supported above the developing sleeve 532 by the casing 58 at a predetermined distance from the surface of the developing sleeve 532.

The toner carried on the circumferential surface of the developing sleeve 532 is regulated to a predetermined layer thickness by the regulating blade 81, and is conveyed toward the developing region by rotation of the developing sleeve 532 (rotation in an arrow direction of FIG. 2). As a developing bias is applied to the developing sleeve 532, a potential difference occurs between the developing sleeve 532 and the photosensitive drum 121 in the developing region. Thus, the toner on the developing sleeve 532 moves to the photosensitive drum 121, and an electrostatic latent image on the photosensitive drum 121 is developed into a toner image.

A toner quantity adjustment mechanism 80 including the regulating blade 81 is arranged at a position facing the circumferential surface of the developing sleeve 532.

Figure 4:
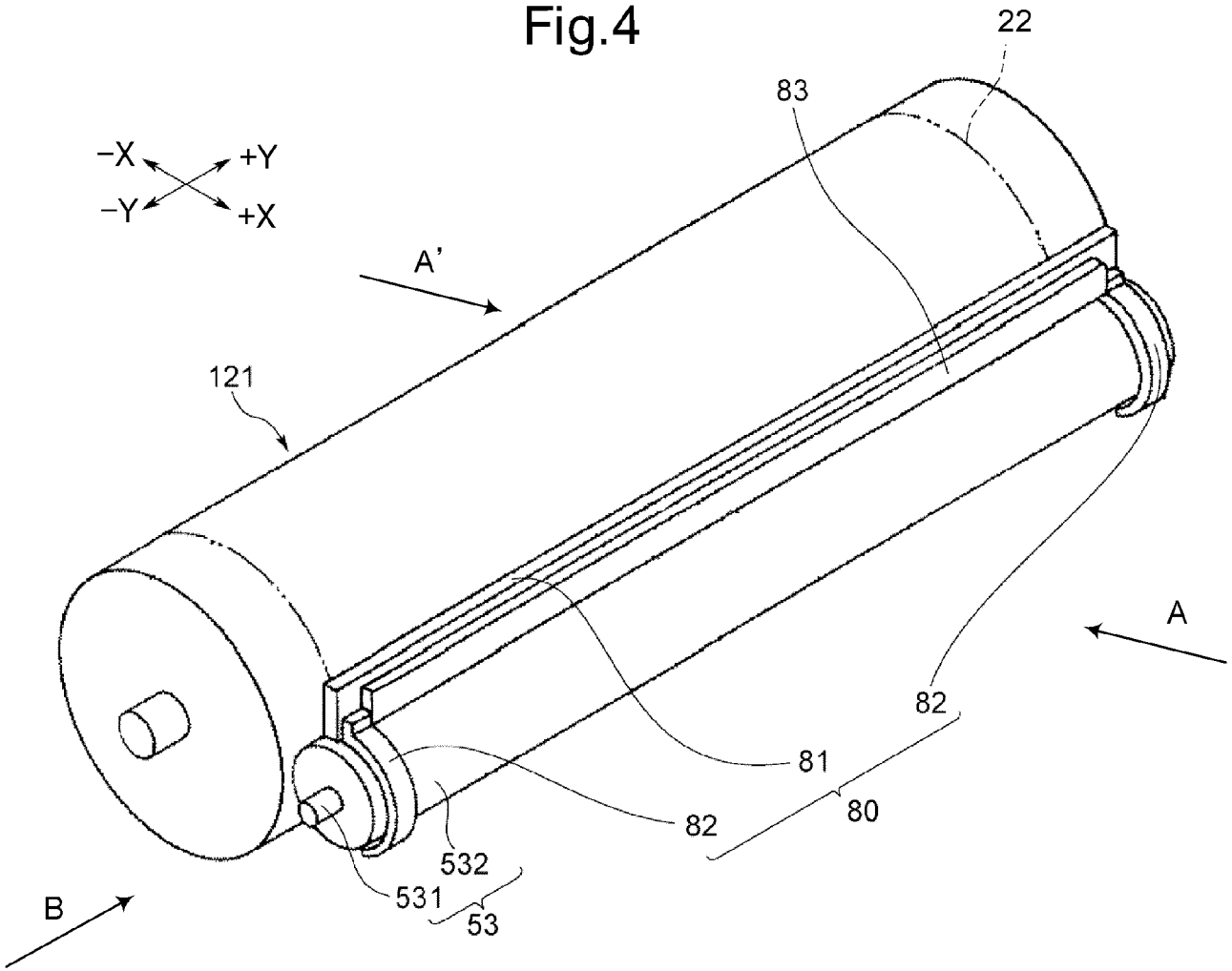
FIG. 4 is a perspective view illustrating portions of a toner quantity adjustment mechanism, a developing roller, and a photosensitive drum.
Figure 5:
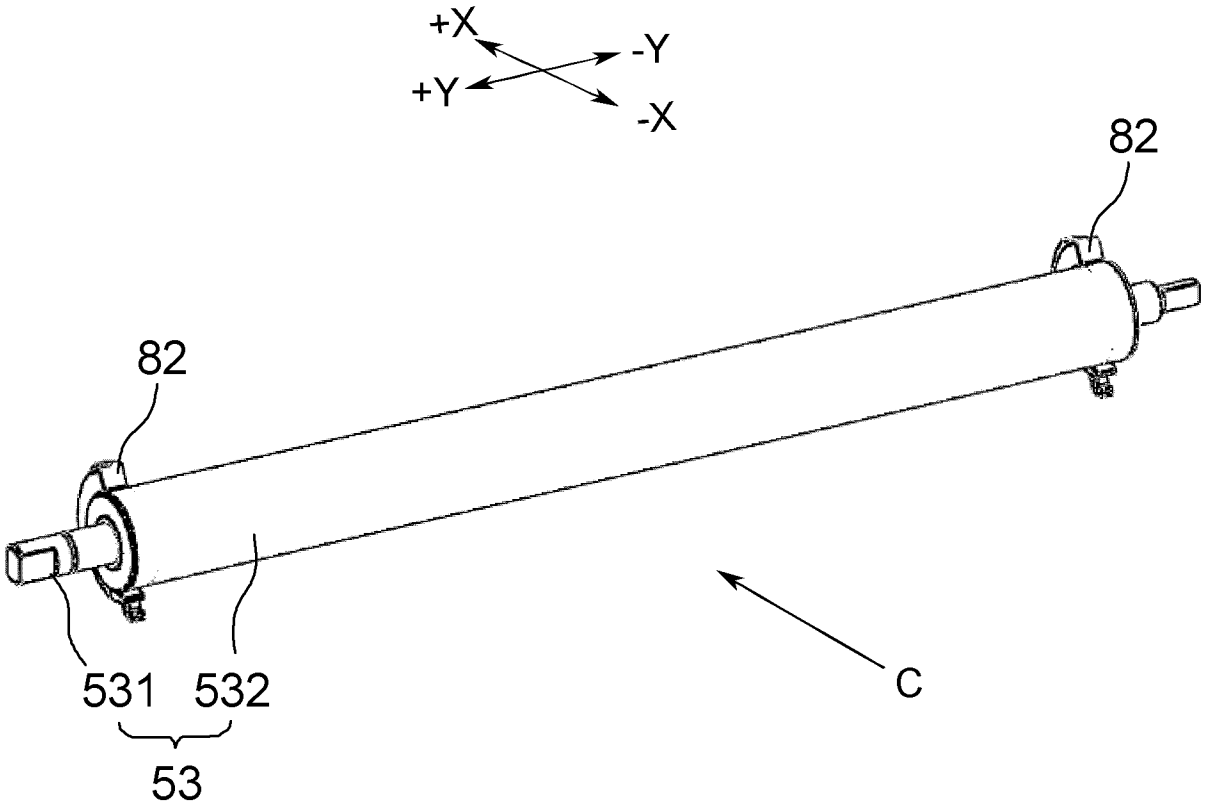
FIG. 5 is a perspective view illustrating portions of the developing roller and seal members which are viewed in a direction of arrow A' of FIG. 4.
Figure 6:
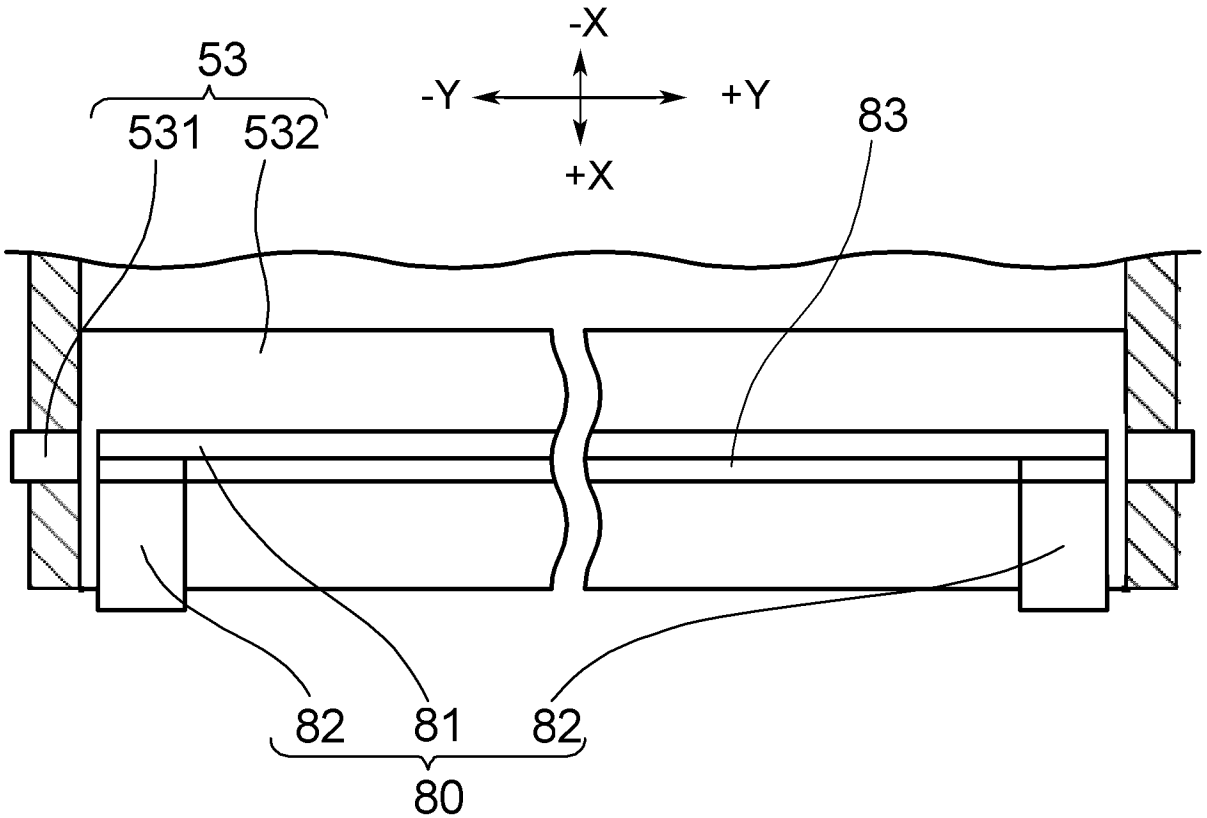
FIG. 6 is a top view illustrating the portions of the toner quantity adjustment mechanism and the developing roller.
Figure 7:
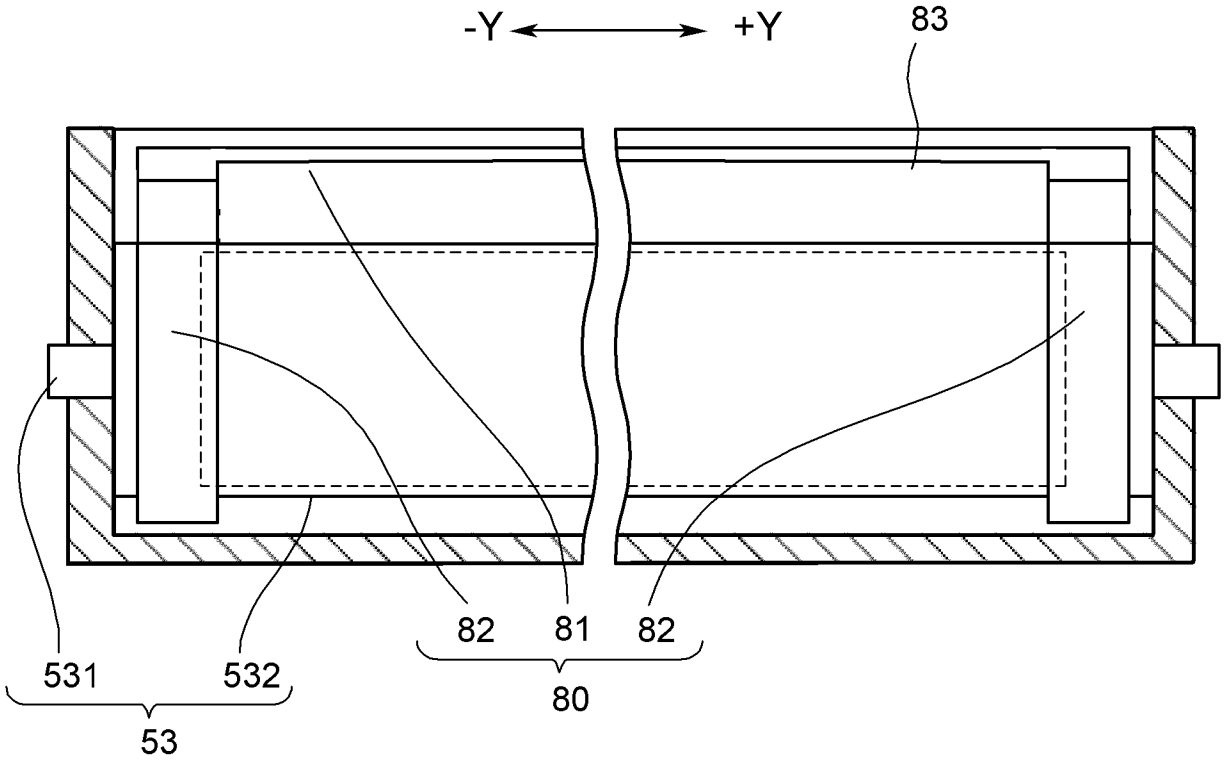
FIG. 7 is a side view of the portions of the toner quantity adjustment mechanism and the developing roller seen in a direction of arrow A of FIG. 4.
Figure 8:
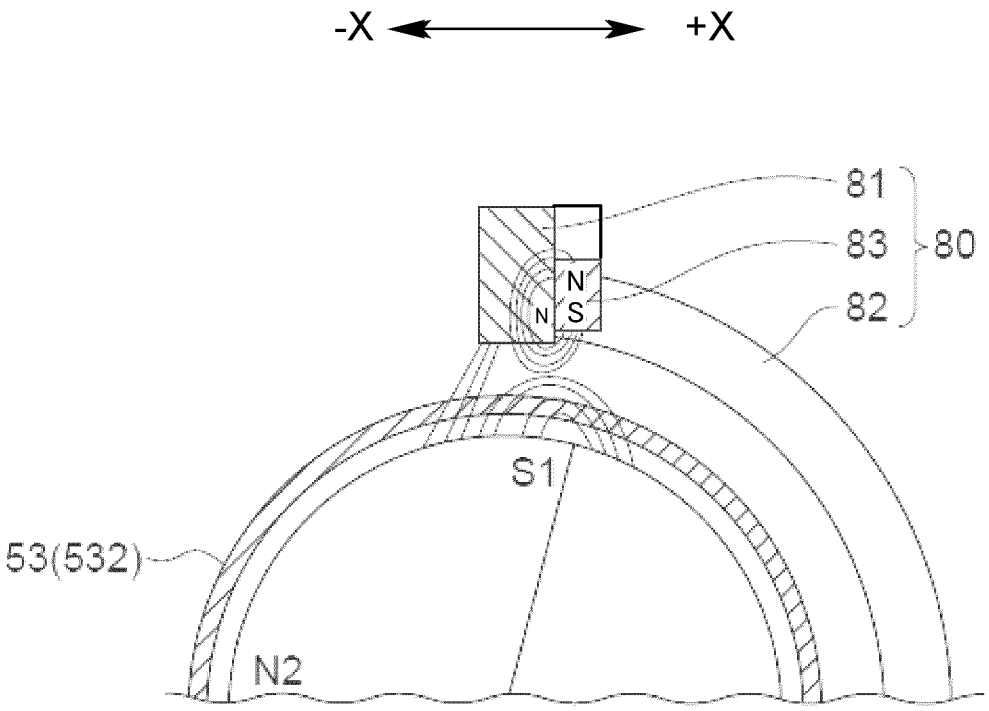
FIG. 8 is a side view of the portions of the toner quantity adjustment mechanism and the developing roller seen in a direction of arrow B of FIG. 4.

FIG. 4 is a perspective view illustrating portions of the toner quantity adjustment mechanism 80, the developing roller 53, and the photosensitive drum 121. FIG. 5 is a perspective view illustrating portions of the developing roller 53 and seal members 82 which are viewed in a direction of arrow A' of FIG. 4. FIG. 6 is a top view illustrating the portions of the toner quantity adjustment mechanism 80 and the developing roller 53. FIG. 7 is a side view of the portions of the toner quantity adjustment mechanism 80 and the developing roller 53 seen in a direction of arrow A of FIG. 4. FIG. 8 is a side view of the portions of the toner quantity adjustment mechanism 80 and the developing roller 53 seen in a direction of arrow B of FIG. 4. Direction indication based on X and Y in FIGS. 4 to 8 is the same as in FIG. 2 (X is the leftward/rightward direction (−X: left side, +X: right side), and Y is the frontward/rearward direction (−Y: front side, +Y: rear side)). Hereinafter, the toner quantity adjustment mechanism 80 will be described with reference to FIGS. 4 to 8 and FIGS. 1 to 3 above.

As illustrated in FIG. 4, the toner quantity adjustment mechanism 80 includes the regulating blade 81, the seal member 82, and a blade magnet 83.

The seal members 82 are made of a magnetic member, and are disposed at respective both ends of the developing sleeve 532 in a rotation axis direction of the developing sleeve 532 while facing the circumferential surface of the developing sleeve 532. The seal members 82 inhibit the toner on the circumferential surface of the developing sleeve 532 from moving to the end side in the rotation axis direction The blade magnet 83 is made of a magnetic member, and is mounted on the regulating blade 81 between arrangement positions of the seal members 82 in a longitudinal direction of the regulating blade 81. The blade magnet 83 is a lateral part of the regulating blade 81, and is mounted on an upstream side of the regulating blade 81 which is located in a direction in which the circumferential surface of the developing sleeve 532 rotates. The blade magnet 83 is configured such that its edge adjacent to the developing sleeve 532 becomes the same S pole as the magnetic pole S1 of the magnet roller 531 inside the developing sleeve 532, and the opposite edge thereto becomes an N pole.

The regulating blade 81 regulates a quantity of the toner fed to the latent image region 22 (the region in which the electrostatic latent image between two-dot chain lines shown in FIG. 4 is formed, i.e. the developing region) of the circumferential surface of the photosensitive drum 121 by the rotation of the circumferential surface of the developing sleeve 532, thereby preventing the toner from being fed excessively. The regulating blade 81 is provided to cross the developing sleeve 532 in the rotation axis direction of the developing sleeve 532 at a position facing the circumferential surface of the developing sleeve 532. While not separately shown, a tip edge of the regulating blade 81 is formed in an edge shape, and is opposite to the circumferential surface of the developing sleeve 532. Such a tip edge is provided at a predetermined distance from the circumferential surface of the developing sleeve 532.

The regulating blade 81 is made of a long blade-like member, and is formed of, for instance, a magnetic material such as stainless steel. As illustrated in FIG. 8, due to a magnetic force of the blade magnet 83, a tip of the regulating blade 81 which is located near the developing sleeve 532 is magnetized into the opposite polarity (N pole) of an end of the blade magnet 83 which is located opposite to the tip. Also, a magnetic field is formed between the tip of the regulating blade 81 and the blade magnet 83. Thus, a magnetic field is formed between the tip of the regulating blade 81 and the developing sleeve 532 by the magnetic poles of the magnet roller 531 in the developing roller 53 and the magnetic poles of the blade magnet 83. Due to these magnetic fields, the toner passes through a gap between the regulating blade 81 and the developing sleeve 532 in a nearly uniform state, and thus a thin layer of toner is formed on the developing sleeve 532.

In this way, the blade magnet 83 and the seal members 82 are mounted on the regulating blade 81. Thereby, the toner on the circumferential surface of the developing sleeve 532 can be properly fed to the circumferential surface of the photosensitive drum 121, and the toner is prevented from being thickened on the circumferential surfaces of the ends of the developing sleeve 532 in the rotation axis direction of the developing sleeve 532.

The seal members 82 prevent the toner from moving from a middle circumferential surface to the ends of the developing sleeve 532 in the rotation axis direction of the developing sleeve 532 until the toner on the circumferential surface of the developing sleeve 532 reaches the arrangement position of the regulating blade 81. The seal members 82 are formed, for instance, in an arcuate shape in which a central angle of curvature is set to about 180° when viewed from the front (seen in a B direction of FIG. 4). As illustrated in FIG. 8, an upper end of each seal member 82 is fixed in contact with a right-hand side of the regulating blade 81. A lower end of each seal member 82 is supported by a part of the casing 58. Thereby, the seal members 82 are arranged at a fixed distance from the circumferential surface of the developing sleeve 532.

Each seal member 82 forms a magnetic brush caused by lines of magnetic force between the seal member 82 and the magnet roller 531 mounted in the developing sleeve 532. Since the magnetic brushes regulate the movement of the toner toward the end sides of the developing sleeve 532 in the rotation axis direction of the developing sleeve 532, the toner is prevented from moving from the circumferential surface to the ends of the developing sleeve 532.

As illustrated in FIG. 7, installation positions of opposite ends of the blade magnet 83 in the frontward/rearward direction of the developing sleeve 532 (in a leftward/rightward direction on the sheet of FIG. 7) are set to be positions of lateral ends of the seal members 82.

Figure 9C:
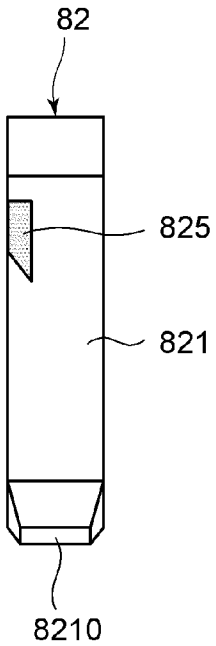
FIG. 9C is a side view of the seal member seen in a direction of arrow C of FIG. 5.
Figure 9B:
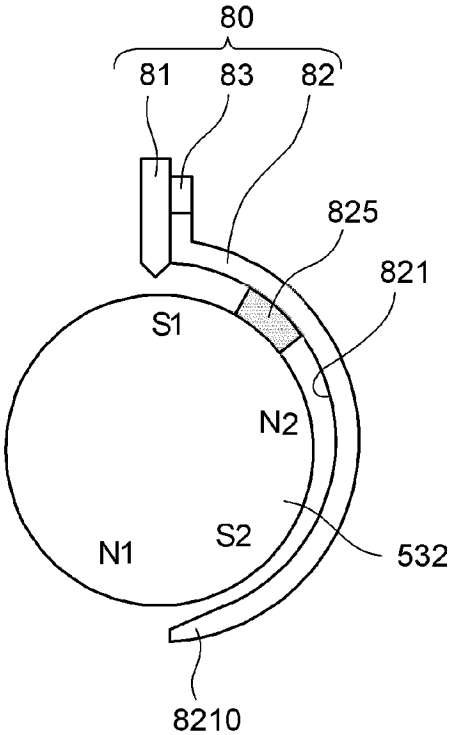
FIG. 9B is a side view of the seal member and the developing roller seen in the direction of arrow B of FIG. 4.
Figure 9A:
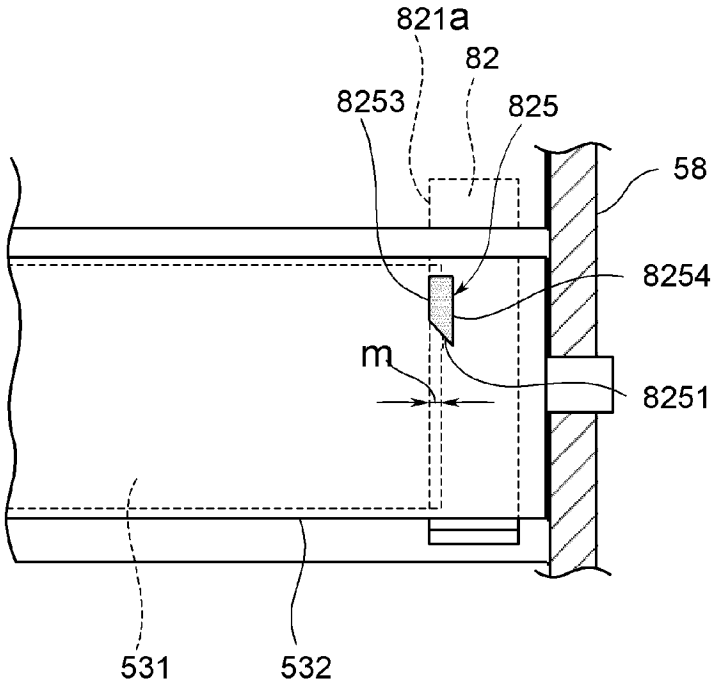
FIG. 9A is a side view of the portions of the developing roller and the seal member seen in a direction of arrow A' of FIG. 4.

The seal member 82 mounted on the developing roller 53 will be described. FIG. 9A is a side view of portions of the developing roller 53 and the seal member 82 seen in a direction of arrow A' of FIG. 4. FIG. 9B is a side view of portions of the seal member 82 and the developing roller 53 seen in a direction of arrow B of FIG. 4, and FIG. 9C is a side view of portions of the seal member 82 seen in a direction of arrow C of FIG. 5.

As illustrated in FIG. 9A, a positional relation between the seal member 82 and the magnet roller 531 is set such that, in the rotation axis direction of the developing sleeve 532, an end of the magnet roller 531 (i.e., an end of a region to which the magnetic force caused by the magnet roller 531 is applied; illustrated in FIG. 9A by a reference numeral 531) and an end of the seal member 82 have an overlapping region m.

Here, the magnetic brush formed between the magnet roller 531 and the seal member 82 has a magnetic flux density that is highest at an edge 821*a* of an inner circumferential surface 821 (a surface opposite to the developing sleeve 532) of the seal member 82, and that is relatively weak at an inner surface part entering the seal member 82 in the rotation axis direction.

Here, when the end of the magnet roller 531 excessively enters up to the inner circumferential surface 821 of the seal members 82 past the edge 821*a* of the seal member 82 in the rotation axis direction, concentration of the magnetic brush is damaged, the toner is transported to the end side of the developing sleeve 532 in the rotation axis direction of the developing sleeve 532 beyond the edge 821*a* of the seal member 82, and toner leakage is liable to take place. Further, even when the end of the magnet roller 531 does not reach the edge 821*a* of the seal member 82 in the rotation axis direction, a magnetic force of constraint is weakened at the edge, and the toner is liable to leak out.

In consideration of these as well as backlash in the rotation axis direction when the magnet roller 531 is installed, a position of the end of the magnet roller 531 in the rotation axis direction is set, for instance, so as to enter the inner circumferential surface 821 from the edge 821*a* of the seal member 82 by 2 mm. In other words, a length of the overlapping region m is set to 2 mm in the rotation axis direction of the developing sleeve 532.

This causes the magnetic brush to be further concentrated in the vicinity of the edge 821*a* of the inner circumferential surface 821 of the seal members 82, so that the overlapping region m is used as a sealed region m due to the seal member 82. Further, the seal member 82 is arranged on the opposite side of the photosensitive drum 121 via the developing sleeve 532.

As illustrated in FIG. 9B, the inner circumferential surface 821 of the seal member 82 and the circumferential surface of the developing sleeve 532 are arranged with a gap. A distance between the inner circumferential surface 821 and the circumferential surface of the developing sleeve 532 is set to, for instance, to 0.3 mm. In the present embodiment, the developing roller 53 is set to ϕ20 mm, and the regulating blade 81 is formed of SUS430. For the seal member 82, iron-based sintering is used. The magnetic poles of the magnet roller 531 encased in the developing sleeve 532 are configured such that S87mT (S1) is arranged adjacent to the arrangement position of the regulating blade 81, and N80mT (N1), S72mT (S2), and N66mT (N2) are arranged in a counterclockwise direction therefrom. Such individual setting is merely one example, and thus this disclosure is not intended to be limited to this individual setting.

Further, as illustrated in FIG. 9C, a tip (jaw part) 8210 that is a portion on a most upstream side in a rotational direction of the circumferential surface of the developing sleeve 532 in the seal member 82 is formed in a tapered shape that is tapered toward the upstream in the rotational direction. Thereby, the toner transported onto the circumferential surface of the developing sleeve 532 by the rotation of the developing sleeve 532 is prevented from accumulating and falling down at the portion of the tip 8210.

Also, as illustrated in FIGS. 9A, 9B, and 9C, a contact member 825 is mounted on the inner circumferential surface 821 of the seal member 82 which is opposite to the circumferential surface of the developing sleeve 532.

The contact member 825 is arranged on the edge 821*a* of the inner circumferential surface 821 of the seal member 82, and is disposed at a position at which the developing region and the overlapping region m of the seal members 82 in the rotation axis direction of the developing sleeve 532 are at least covered.

Furthermore, the contact member 825 is disposed at a position at an upstream side relative to the arrangement position of the regulating blade 81 in the rotational direction of the circumferential surface of the developing sleeve 532. The contact member 825 has the same thickness as a gap distance between the circumferential surface of the developing sleeve 532 and the inner circumferential surface 821 of the seal members 82, and is in contact with the circumferential surface of the developing sleeve 532.

Further, as illustrated in FIG. 9A, the contact member 825 is formed such that its lateral part 8253 located at the middle side of the developing sleeve 532 in the rotation axis direction of the developing sleeve 532 is shorter than its lateral part 8254 located at the opposite side. Furthermore, the contact member 825 has a slanted shape in which its edge 8251 located at an upstream side in the rotational direction of the circumferential surface of the developing sleeve 532 is inclined toward the middle side of the developing sleeve 532. The contact member 825 is formed of a material such as a microcell polymer sheet (PORON (registered trademark)).

When the toner on the circumferential surface of the developing sleeve 532 is conveyed to the position of the edge 8251 of the contact member 825 by the rotation of the developing sleeve 532 and comes into contact with the edge 8251, the toner on the circumferential surface of the developing sleeve 532 moves to the middle side of the developing sleeve 532 along the inclination of the edge 8251 in the rotation axis direction of the developing sleeve 532 by means of a pressing force applied to a downstream side in the rotational direction of the circumferential surface of the developing sleeve 532 due to the circumferential surface of the developing sleeve 532. Thereby, the toner moves to a region deviating from the sealed region m.

Thus, in the present embodiment, an external force is applied to the toner constrained by a magnetic force between the developing sleeve 532 and the seal member 82 by bringing the contact member 825 into contact with the circumferential surface of the developing sleeve 532, thereby causing the toner to move outside the sealed region m. For this reason, new toner is constantly fed to the sealed region m due to the seal member 82, and a situation in which the same toner continues to be rubbed by the developing sleeve 532 can be avoided. As such, the toner can be prevented from being charged excessively.

Further, when the contact member 825 is provided at a downstream side in the rotational direction of the circumferential surface of the developing sleeve 532, i.e. at a position facing the surface of the photosensitive drum 121, with respect to the regulating blade 81, this causes a problem that a layer of the displaced toner easily flies to the surface of the photosensitive drum 121. However, in the present embodiment, since the contact member 825 is provided at a position at an upstream side in the rotational direction of the circumferential surface of the developing sleeve 532 relative to the regulating blade 81, such a problem does not occur. At such an upstream position, the toner is displaced to the developing region side of the developing sleeve 532 (the middle side of the developing sleeve 532 in the rotation axis direction of the developing sleeve 532) by the contact member 825. As such, the displaced toner is regulated in thickness by the regulating blade 81, and the toner layer does not thicken beyond expectation at the portion of the circumferential surface of the developing sleeve 532 which is opposite to the surface of the photosensitive drum 121. Thus, according to the present embodiment, by preventing the toner from being excessively charged in the sealed region m due to the seal member 82, toner fog and toner scattering can be avoided while the toner is prevented from leaking out of the developing device 122.

For example, in the developing device A illustrated in the section BACKGROUND, the layer of the toner scraped by the scraping member thickens accordingly. In the developing device A, the scraping member is provided at a position at a downstream side in a rotational direction of the circumferential surface of the developing sleeve relative to the layer regulating member for regulating the thickness of the toner layer on the developing sleeve. As such, the thickened toner layer approaches the surface of the photosensitive drum, becomes toner fog, and easily flies to the surface of the photosensitive drum. Further, the toner layer is easily scattered by a centrifugal force caused by the rotation of the developing sleeve, which leads to contamination in the apparatus body.

Further, in the case of the developing device B illustrated in the section BACKGROUND, although it is possible to prevent the developer from accumulating on the tip of the seal member, the toner remains in the sealed region caused by the seal member. If the toner remains in the sealed region caused by the seal member, and the toner layer is formed, the toner in the sealed region is rubbed by the developing sleeve for a long time unlike the toner inside the developing container. Thus, the toner layer is excessively charged with ease. If the toner layer is excessively charged, a difference in a charged amount between lower-layer toner, which is in contact with the developing sleeve, and upper-layer toner is increased. In other words, since distribution of the charged amount is broadened, the toner of the broadened portion becomes fog, and easily flies to the surface side of the photosensitive drum. Further, a toner conveyance amount (toner layer thickness) on the developing sleeve is determined by a resultant force of a physical conveying force caused by a sleeve surface shape and an electrostatic conveying force for electrostatically conveying surrounding toner that is uncharged and charged weakly and reversely by charging of the lower-layer toner. For this reason, as the lower layer toner is excessively charged as described above, the electrostatic conveying force is increased, so that the toner layer formed in the sealed region is thickened compared to the other portion (excluding the sealed region), which leads to the problems such as toner fog and toner scattering.

In contrast, the above embodiment makes it possible, as described above, to avoid the toner fog and the toner scattering by preventing the toner in the sealed region caused by the seal members from being excessively charged, while the toner is prevented from leaking out of the developing device.

Figure 10:
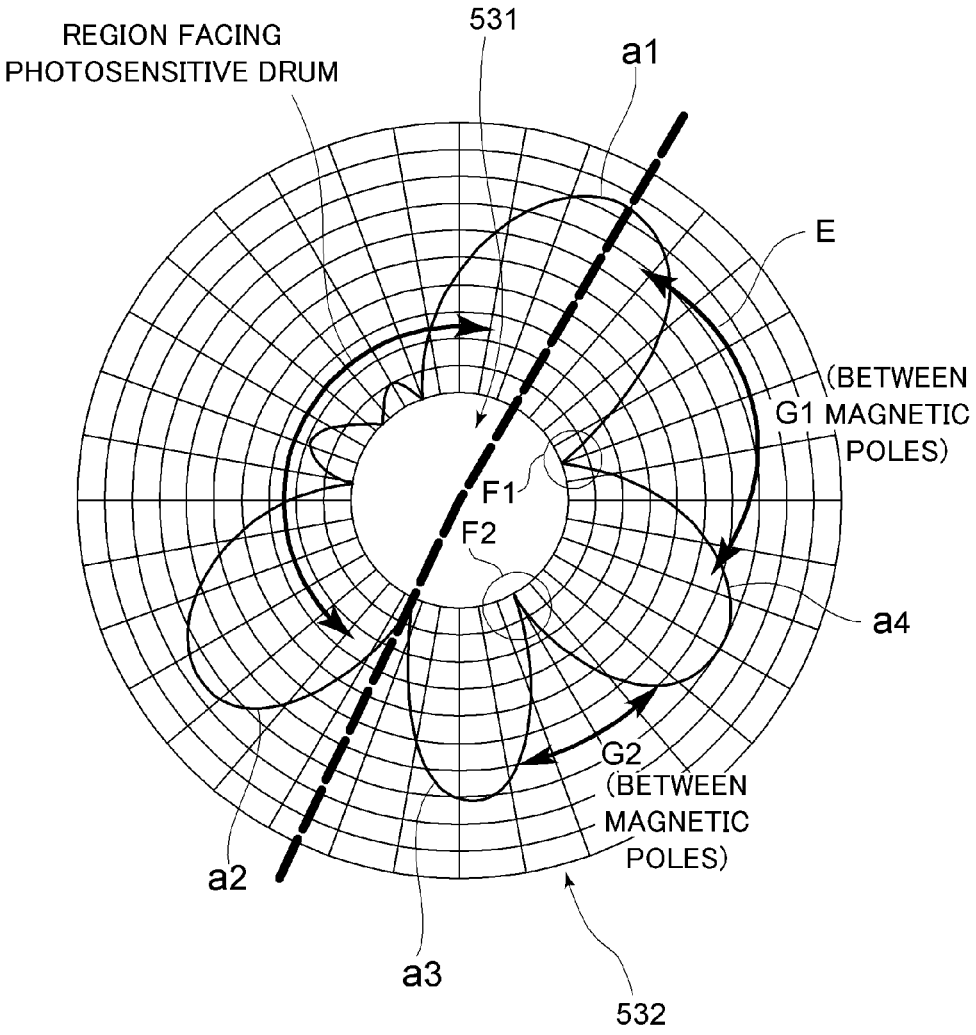
FIG. 10 is a conceptual view illustrating the distribution of a magnetic force which a magnet roller generates in a developing sleeve.

An optimum mounting position of the contact member 825 will be described in greater detail. FIG. 10 is a conceptual view illustrating the distribution of a magnetic force which the magnet roller 531 generates in the developing sleeve 532.

Regarding the inner circumferential surface 821 of the seal members 82, the mounting position of the contact member 825 in the rotational direction of the circumferential surface of the developing sleeve 532 is not particularly limited, but a mounting position illustrated below is further preferred.

The contact member 825 is adapted to apply an external force to the toner on the circumferential surface of the developing sleeve 532 and to displace the toner. As such, if the toner present on the circumferential surface of the developing sleeve 532 is in an easily movable state, it is possible to move the toner out of the sealed region m in a more reliable way.

Since the toner on the circumferential surface of the developing sleeve 532 is adsorbed on the surface of the developing sleeve 532 by the magnetic force which the magnet roller 531 inside the developing sleeve 532 generates, the contact member 825 is brought into contact with the toner at a position at which the magnetic force is weak. Thereby, it is possible to easily move the toner out of the sealed region m.

Further, when the contact member 825 is arranged at a position facing the surface of the photosensitive drum 121, the toner layer formed by the toner scraped by the contact member 825 is reduced in the distance up to the surface of the photosensitive drum 121 due to its thickness, and the toner easily flies to the surface of the photosensitive drum 121. As such, the contact member 825 is preferably not arranged at the facing position.

Here, as illustrated in FIG. 9B, the magnetic poles of the magnet roller 531 are set to S87mT, N80mT, S72mT, and N66mT in a counterclockwise direction from the arrangement position of the regulating blade 81. For this reason, a magnetic force is generated from the magnet roller 531 toward the developing sleeve 532 within given ranges a1, a2, a3, and a4 from the respective magnetic poles in a radial direction of the magnet roller 531. Thus, on the circumferential surface of the developing sleeve 532, a range indicated by arrow E in the rotational direction of the circumferential surface of the developing sleeve 532 becomes an inter-magnetic-pole region G1 in which the magnetic force generated by the magnetic poles is weak. Thereby, regarding the inner circumferential surface 821 of the seal member 82, a position facing the inter-magnetic-pole region G1 in the rotational direction of the developing sleeve 532 is suitable as the arrangement position of the contact member 825. FIG. 9B illustrates a state in which the contact member 825 is arranged on the inner circumferential surface 821 facing the inter-magnetic-pole region G1.

Figure 11C:
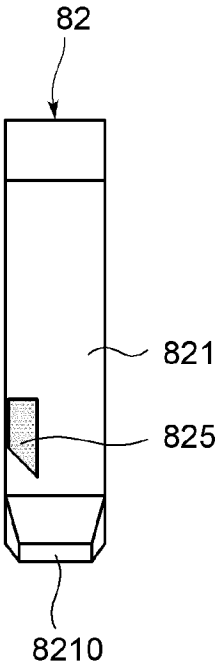
FIG. 11C is a side view of the seal member seen in a direction of arrow C of FIG. 5.
Figure 11B:
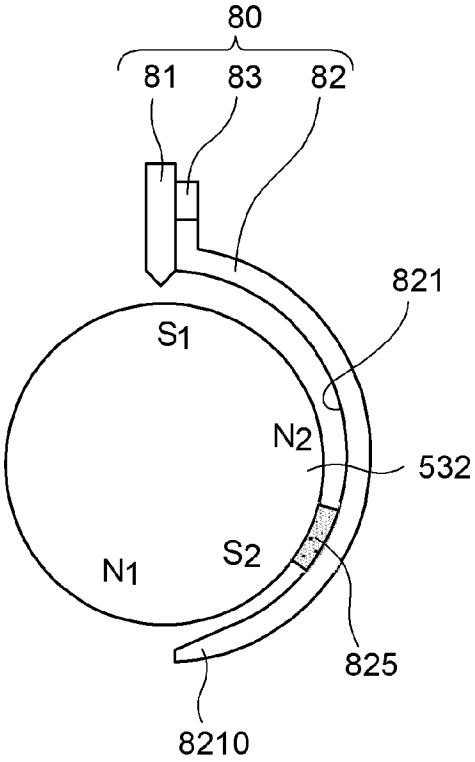
FIG. 11B is a side view of the seal member and the developing roller seen in the direction of arrow B of FIG. 4 in the state in which the contact member is arranged on the inner circumferential surface facing the inter-magnetic-pole region G2.
Figure 11A:
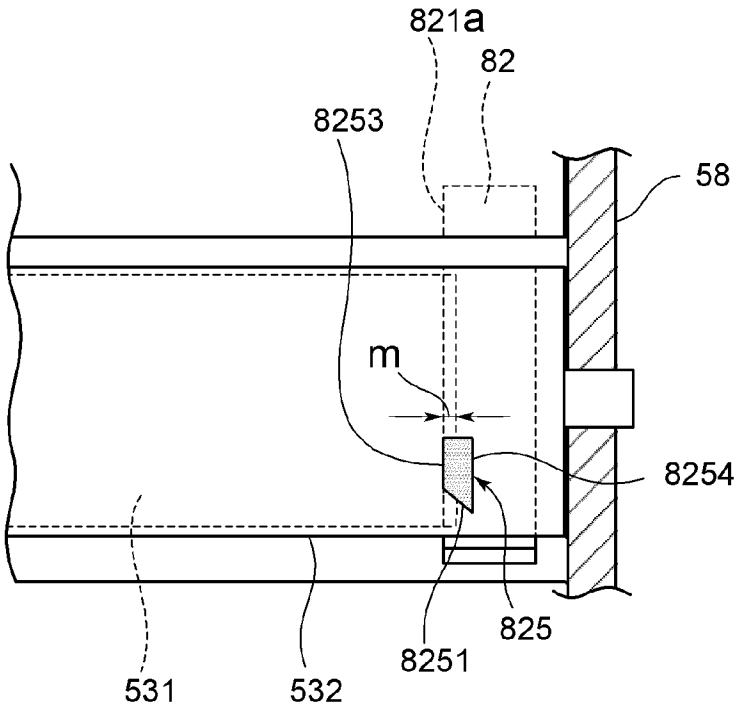
FIG. 11A is a side view of the portions of the developing roller and the seal member seen in the direction of arrow A' of FIG. 4 in a state in which a contact member is arranged on an inner circumferential surface facing an inter-magnetic-pole region G2.

In addition, even when the contact member 825 is arranged in another inter-magnetic-pole region G2 illustrated in FIG. 10, an effect of easily moving the toner is obtained. FIG. 11A is a view illustrating a state in which the contact member 825 is arranged on the inner circumferential surface 821 facing the inter-magnetic-pole region G2, and a side view of the portions of the developing roller 53 and the seal member 82 seen in the direction of the arrow A of FIG. 4. Similarly, FIG. 11B is a view illustrating a state in which the contact member 825 is arranged on the inner circumferential surface 821 facing the inter-magnetic-pole region G2, and a side view of the seal member 82 and the developing roller 53 seen in the direction of the arrow B of FIG. 4. FIG. 11C is a side view of the seal member 82 seen in a direction of arrow C of FIG. 5.

Further, regions F1 and F2 illustrated in FIG. 10 are magnetic force zero regions in which the magnetic force generated by each magnetic pole is weakest. For this reason, when the contact member 825 is arranged on the inner circumferential surface 821 of the seal members 82 at a position facing the magnetic force zero regions F1 and F2, it is possible to move the toner more reliably.

Next, a shape of the contact member 825 will be described. FIGS. 12A, 12B, 13C, 13D, 14E, and 14F are views illustrating a shape of the contact member 825.

Figure 12A:
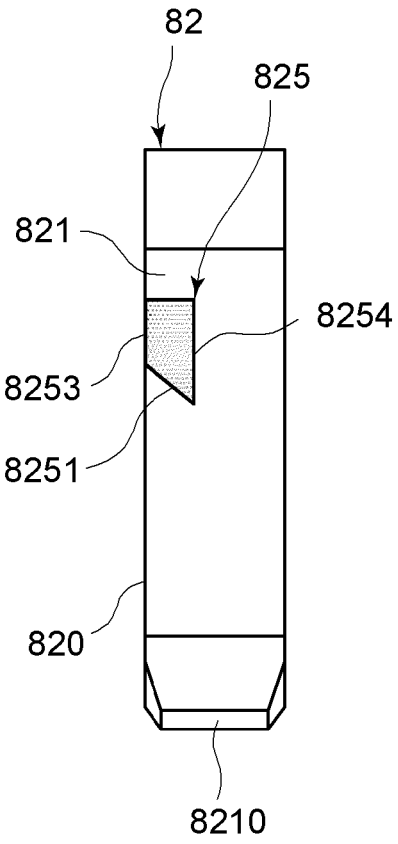
FIG. 12A is a view illustrating a shape of the contact member.

As illustrated in FIG. 12A, the aforementioned contact member 825 is provided for a part of the seal members 82 in a widthwise direction of the seal members 82 so as to have a slanted part on an edge 8251 of a most upstream part in the rotational direction of the developing sleeve 532 and to cause a lateral edge 8252 to coincide with the edge 820 of the seal member 82.

Figure 12B:
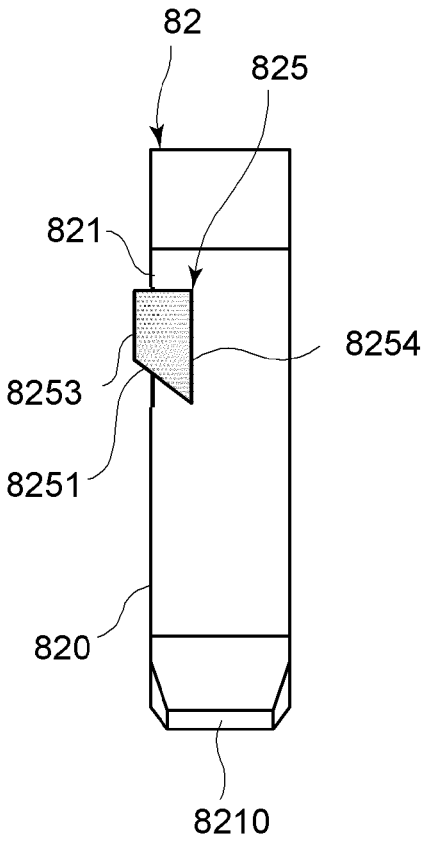
FIG. 12B is a view illustrating a shape of the contact member.

Here, as illustrated in FIG. 12B, the contact member 825 may be arranged to overlap the edge 820 and the sealed region m. In other words, the contact member 825 is arranged to protrude to the middle side of the developing sleeve 532 in the rotation axis direction of the developing sleeve 532, so that an effect of moving the toner more easily can be increased.

Figure 13C:
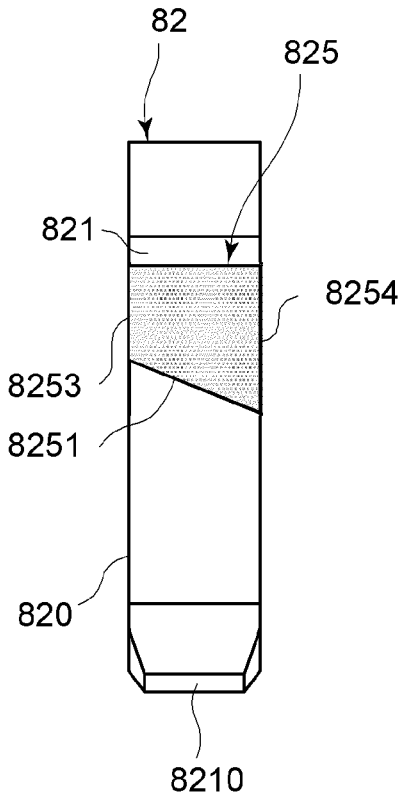
FIG. 13C is a view illustrating a shape of the contact member.
Figure 13D:
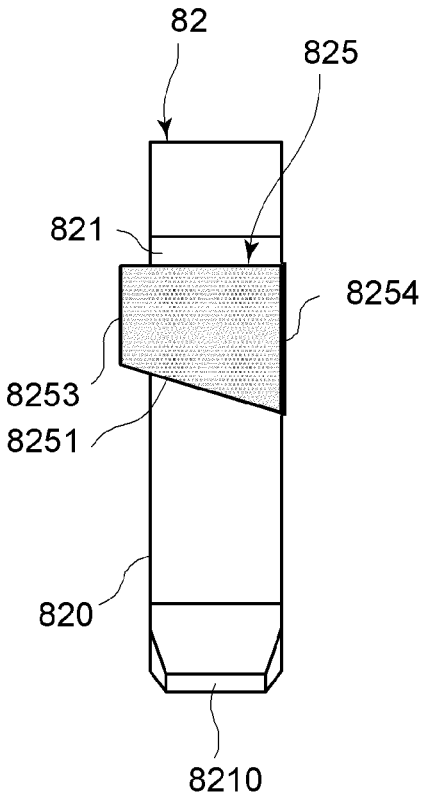
FIG. 13D is a view illustrating a shape of the contact member.

Further, as in FIGS. 13C and 13D, even when the contact member 825 is disposed throughout the width of the seal member 82, the same effect is obtained. Since the toner layer is only formed up to the vicinity of the edge 820 on the inner circumferential surface 821 of the seal members 82, the portion of the contact member 825 other than the vicinity of the edge 820 does not directly contribute to the movement of the toner. The effect of easily moving the toner is obtained with this shape as well. For this reason, as illustrated in FIGS. 12A and 12B, installing the contact member 825 only on a part of the seal members 82 in the widthwise direction of the seal members 82 is optimum from the viewpoint of torque and heat generation.

Figure 14E:
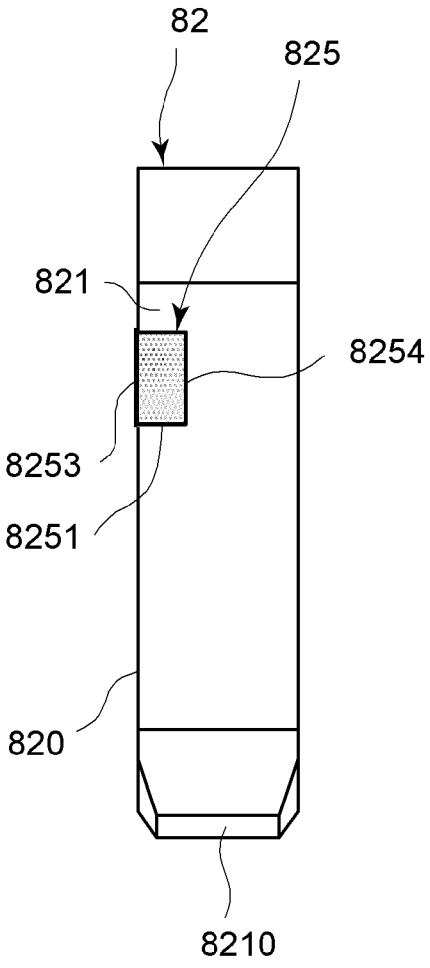
FIG. 14E is a view illustrating a shape of the contact member.
Figure 14F:
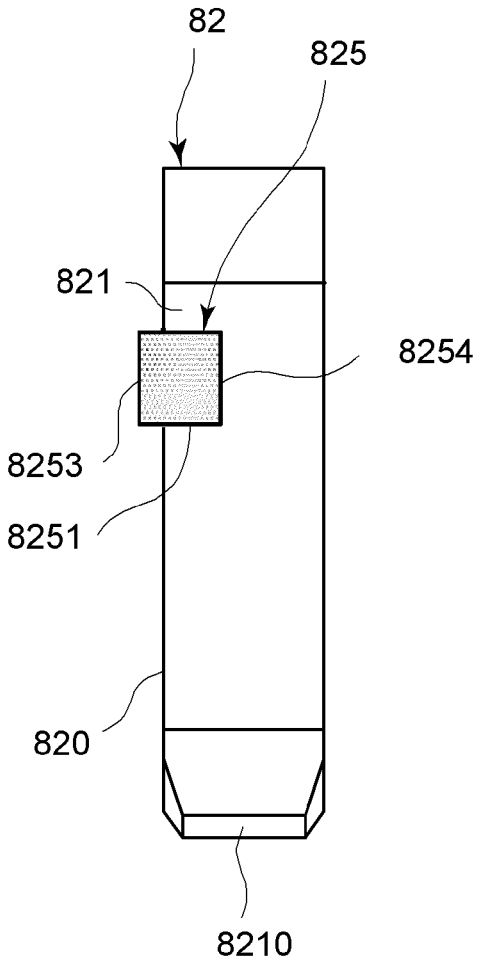
FIG. 14F is a view illustrating a shape of the contact member.

As illustrated in FIGS. 14E and 14F, even when the contact member 825 has a shape in which its edge 8251 of a most upstream part in the rotational direction of the developing sleeve 532 has a flat shape without having the slanted shape, i.e., its edge 8251 extends in a direction orthogonal to the rotational direction of the circumferential surface of the developing sleeve 532, an effect of moving the toner out of the sealed region m is obtained.

This disclosure is not limited to the constitutions of the embodiments, but various modifications are possible. The constitution and processing illustrated in each embodiment using FIGS. 1 to 14F are merely one embodiment of this disclosure, and the constitution and processing of this disclosure are not limited thereto.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device comprising:

a developing roller configured to include a magnet roller having numerous magnetic poles in a circumferential direction thereof and a roller-shaped developing sleeve sheathed on the magnet roller and to feed toner to a photosensitive drum;

a regulating blade configured to extend in a rotation axis direction of the developing sleeve, disposed opposite to a circumferential surface of the developing sleeve, and configured to regulate a quantity of the toner present on the circumferential surface of the developing sleeve;

seal members disposed opposite to the circumferential surface without being in contact with both ends of the developing region in the rotation axis direction on the circumferential surface of the developing sleeve, and configured to inhibit the toner on the developing region from moving to the rotation axis direction ends by magnetic brushes formed between the magnet roller and the seal members; and contact members, each configured as an edge on the developing region side in the rotation axis direction on an inner circumferential surface of each seal member which is opposite to the circumferential surface of the developing sleeve, provided at a position at an upstream side in a rotational direction of the circumferential surface of the developing sleeve relative to an arrangement position of the regulating blade, and configured to be in contact with the circumferential surface of the developing sleeve.

2. The developing device according to claim 1, wherein the contact members are each provided at a position of the inner circumferential surface which is between the magnetic poles of the magnet roller in the rotational direction of the circumferential surface of the developing sleeve.

3. The developing device according to claim 1, wherein the contact members are each provided at a position of the inner circumferential surface which corresponds to a position at which no vertical magnetic force is generated between the magnet roller and the seal member in the rotational direction of the circumferential surface of the developing sleeve.

4. The developing device according to claim 1, wherein each of the contact members has a slanted shape in which an edge thereof on a most upstream side in the rotational direction of the circumferential surface of the developing sleeve is inclined toward a middle side of the developing sleeve in the rotation axis direction of the circumferential surface of the developing sleeve.

5. The developing device according to claim 4, wherein the slanted shape formed at the end of the contact member is configured such that a length of the contact member is reduced in the rotational direction of the circumferential surface of the developing sleeve with the approach to the developing region side.

6. The developing device according to claim 1, wherein each of the contact members is provided such that a part thereof protrudes from the edge to the developing region side of the circumferential surface of the developing sleeve on the inner circumferential surface of the seal member.

7. An image forming apparatus comprising:

an image carrier, on a surface of which a toner image is formed;

a charging part configured to charge the surface of the image carrier;

an exposing part configured to expose the surface of the image carrier, which is charged by the charging part, to form an electrostatic latent image; and a developing device configured to feed toner to the electrostatic latent image formed by the exposing part and to form the toner image, wherein the developing device includes:

a developing roller configured to include a magnet roller having numerous magnetic poles in a circumferential direction thereof and a roller-shaped developing sleeve sheathed on the magnet roller and to feed the toner to a photosensitive drum;

a regulating blade configured to extend in a rotation axis direction of the developing sleeve, disposed opposite to a circumferential surface of the developing sleeve, and configured to regulate a quantity of the toner on the circumferential surface of the developing sleeve;

seal members disposed opposite to the circumferential surface without being in contact with both ends of the developing region in the rotation axis direction on the circumferential surface of the developing sleeve, and configured to inhibit the toner on the developing region from moving to the rotation axis direction ends by magnetic brushes formed between the magnet roller and the seal members; and contact members, each configured as an edge on the developing region side in the rotation axis direction on an inner circumferential surface of each seal member which is opposite to the circumferential surface of the developing sleeve, provided at a position at an upstream side in a rotational direction of the circumferential surface of the developing sleeve relative to an arrangement position of the regulating blade, and configured to be in contact with the circumferential surface of the developing sleeve.

* * * * *